US008014714B2

(12) United States Patent
Donald et al.

(10) Patent No.: US 8,014,714 B2
(45) Date of Patent: Sep. 6, 2011

(54) FUSERS, PRINTING APPARATUSES AND METHODS OF FUSING TONER ON MEDIA

(75) Inventors: Steven Donald, Lyons, NY (US); Christopher L. Bradley, Webster, NY (US); Fred Johnson, Seneca Castle, NY (US); Thomas Simpson, Webster, NY (US); Robert Arnold, Byron, NY (US)

(73) Assignee: Xerox Corporation, Norwalk, CT (US)

( * ) Notice: Subject to any disclaimer, the term of this patent is extended or adjusted under 35 U.S.C. 154(b) by 472 days.

(21) Appl. No.: 12/200,328

(22) Filed: Aug. 28, 2008

(65) Prior Publication Data

US 2010/0054784 A1 Mar. 4, 2010

(51) Int. Cl.
*G03G 15/20* (2006.01)

(52) U.S. Cl. ..... 399/333; 399/67; 399/334

(58) Field of Classification Search ..... 399/67, 399/122, 328, 329, 330, 333, 334
See application file for complete search history.

(56) References Cited

U.S. PATENT DOCUMENTS 5,621,512 A * 4/1997 Uehara et al. ..... 399/328
6,122,479 A * 9/2000 Fujita et al. ..... 399/333
6,564,033 B2 5/2003 Zhou et al.
6,646,228 B2 11/2003 Axinte et al.
6,797,924 B1 9/2004 Axinte et al.
6,831,252 B1 12/2004 Crookshanks
7,228,082 B1 6/2007 Davidson et al.
2003/0228179 A1 12/2003 Yaomin et al.
2004/0042827 A1 * 3/2004 Izawa et al. ..... 399/328
2005/0006370 A1 1/2005 Suzumi
2006/0198670 A1 * 9/2006 Baba et al. ..... 399/323
2008/0037069 A1 2/2008 Mestha et al.

OTHER PUBLICATIONS

Wikipedia; ColdHeat; http://en.wikipedia.org/wiki/ColdHeat.
Article Cache; Use Cold Heat to Race Through Household Projects; http://www.articlecache/com/articledetail.php?artid=12587&catid=280&title=Use+Cold+ . . . .
MSNBC; Cold Heat Soldering Tool At Work On A Circuit Board; http://www.msnbc.msn.com/id/6151688.
Seattle Post Intelligencer; Cold Heat Comes Up with A Hot New Way to Solder; http://seattlepi.nwsource.com/business/152624_coldheat16.html; Dec. 16, 2003.
Gary Krakow; MSNBC; Cold Heat Runs Hot and Cold; http://www.msnbc.msn.com/id/6151688/print/1/displaymode/1098/; Oct. 8, 2004.

* cited by examiner

*Primary Examiner* — David M Gray
*Assistant Examiner* — Joseph S Wong
(74) *Attorney, Agent, or Firm* — Ronald E. Prass, Jr.; Prass LLP

(57) ABSTRACT

Fusers, printing apparatuses and methods of fusing toner on media are disclosed. An embodiment of a fuser for heating media includes a fuser roll including an outer portion having a first outer surface; a voltage source connected to the outer portion and adapted to supply voltage to the outer portion to heat the first outer surface; a pressure roll having a second outer surface; and a nip between the first and second outer surfaces. The first and second outer surfaces are adapted to contact a medium at the nip.

15 Claims, 6 Drawing Sheets

FUSERS, PRINTING APPARATUSES AND METHODS OF FUSING TONER ON MEDIA

BACKGROUND

Fusers, printing apparatuses and methods of fusing toner on media.

In some printing processes, toner images are formed on media and the media are then heated to fuse the toner onto the media. Printing apparatuses used for such printing processes can include a fuser having a fuser member and a pressure roll. During printing processes, media carrying toner images are fed to a nip formed between the fuser member and pressure roll, which apply heat and pressure to the media to fuse the toner images.

It would be desirable to provide apparatuses and printing processes that can fuse toner on media more efficiently.

SUMMARY

According to aspects of the embodiments, fusers, printing apparatuses and methods of fusing toner on media are disclosed.

An exemplary embodiment of a fuser for heating media comprises a fuser roll including an outer portion having a first outer surface; a voltage source connected to the outer portion and adapted to supply voltage to the outer portion to heat the first outer surface; a pressure roll having a second outer surface; and a nip between the first and second outer surfaces. The first and second outer surfaces are adapted to contact a medium at the nip.

DRAWINGS

DETAILED DESCRIPTION

The disclosed embodiments include a fuser for heating media, which comprises a fuser roll including an outer portion having a first outer surface; a voltage source connected to the outer portion and adapted to supply voltage to the outer portion to heat the first outer surface; a pressure roll having a second outer surface; and a nip between the first and second outer surfaces. The first and second outer surfaces are adapted to contact a medium at the nip.

The disclosed embodiments further include a fuser for heating media, which comprises a fuser roll including an outer portion having a first outer surface, the outer portion being comprised of graphite or a graphite-containing material; a pressure roll having a second outer surface; and a nip between the first and second outer surfaces. The first and second outer surfaces are adapted to contact a medium at the nip.

The disclosed embodiments further include a fuser for heating media, which comprises a continuous fuser belt having an outer fusing surface and an opposite inner surface; a graphite or graphite-containing material including a heating surface disposed inside of the fuser belt in contact with the inner surface; a voltage source connected to the material and adapted to supply voltage to the material to heat the heating surface, which heats the fuser belt; a pressure roll having an outer surface; and a nip between the heating surface and the outer surface. The fusing surface and the outer surface are adapted to contact a medium at the nip.

The disclosed embodiments further include a fuser for heating media, which comprises a continuous fuser belt having an outer fusing surface and an opposite inner surface; a heating surface inside of the fuser belt and in contact with the inner surface, the heating surface being comprised of graphite or a graphite-containing material; a pressure roll having an outer surface; and a nip between the heating surface and the outer surface. The fusing surface and the outer surface are adapted to contact a medium at the nip.

The disclosed embodiments further include a method of fusing toner on a medium, which comprises feeding a medium having toner thereon to a nip between an outer fusing surface of a fuser member and an outer surface of a pressure roll; applying a voltage to a graphite or graphite-containing material that forms the fusing surface or supports the fusing surface so as to heat the fusing surface; and contacting the medium with the fusing surface and the outer surface to fuse the toner onto the medium.

Figure 1:
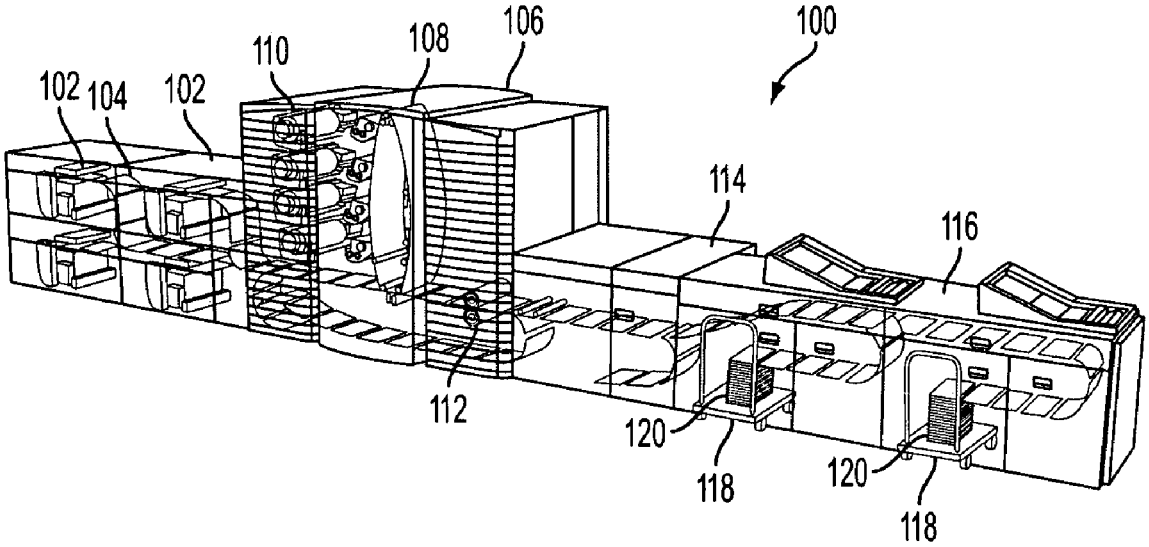
FIG. 1 illustrates an exemplary embodiment of a printing apparatus.

FIG. 1 illustrates an exemplary printing apparatus 100, such as disclosed in U.S. Patent Application Publication No. 2008/0037069, which is incorporated herein by reference in its entirety. As used herein, the term "sprinting apparatus" encompasses any apparatus, such as a digital copier, bookmaking machine, multifunction machine, and the like, that performs a print outputting function for any purpose. The printing apparatus 100 can be used to produce prints from various media, such as coated or uncoated (plain) paper sheets. The media can have various sizes and weights. In embodiments, the printing apparatus 100 has a modular construction. As shown, the apparatus includes media two feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed media having various sizes (widths and lengths) and weights to the printer module 106. In the printer module 106, toner is transferred from an arrangement of developer stations 110 to a charged photoreceptor belt 108 to form toner images on the photoreceptor belt. The toner images are transferred to one side of respective media 104 fed through the paper path. The media are advanced through a fuser 112 including rolls adapted to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In the fuser 112, at least one roll that contacts media is heated. It is desirable to reduce the amount of energy that is used to fuse toner onto media in the fuser 112.

The amount of thermal energy (heat) that needs to be supplied to thicker media to fuse toner on them exceeds the amount of heat that needs to be supplied to thinner media of the same material to fuse the same toner on the thinner media. More energy is also needed to affix toner on coated media than on uncoated media. When using a fuser including a heated fuser roll, or a heated fuser belt, to print different types of media, the temperature of the fuser roll or fuser belt can be changed during print jobs. For example, toner can be fused on thin media at a first temperature set point of the fuser roll or fuser belt. To then heat thick media in the print job to a sufficiently-high temperature to fuse toner on the thick media, the temperature of the fuser roll or fuser belt can be increased to a second temperature set point. Increasing the temperature of the fuser roll or fuser belt to such a higher temperature set point during a print job requires increasing the amount of heat supplied to the fuser roll or fuser belt. However, due to the thermal mass of such fuser rolls or support rolls, it can typically take a significant amount of time to heat the fuser roll or fuser belt from the first temperature set point to the second temperature set point by heating the fuser roll or support rolls. Consequently, this approach can cause a significant time delay in print jobs, in addition to the amount of energy consumed to heat the roll(s) to the desired temperature set point.

Figure 2:
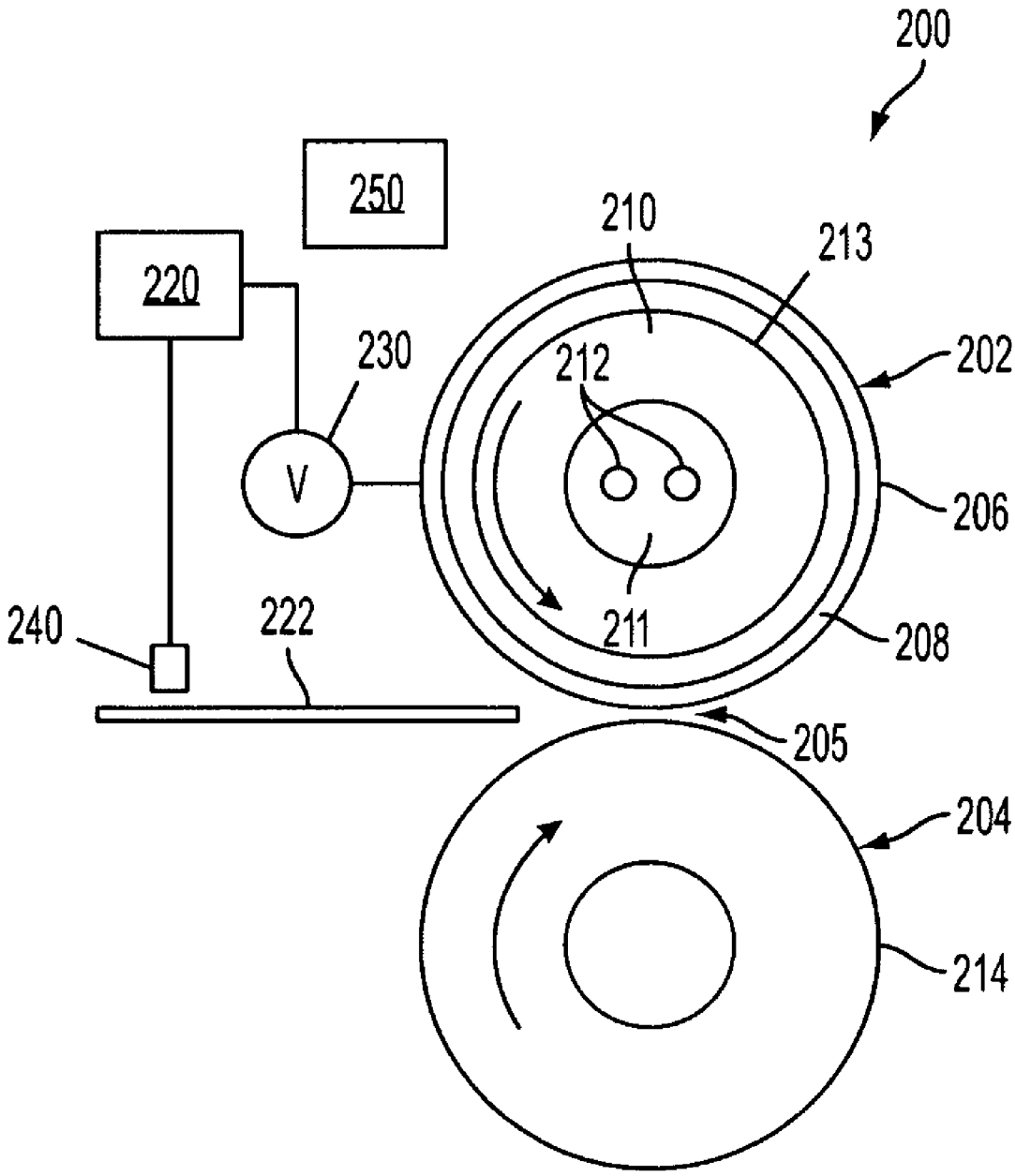
FIG. 2 illustrates an exemplary embodiment of a fuser including a fuser roll.

FIG. 2 illustrates a fuser 200 according to an exemplary embodiment. The fuser 200 is constructed to provide thermally-efficient fusing of toner on media in printing apparatuses. Embodiments of the fuser 200 can be used in different types of printing apparatuses. For example, the fuser 200 can be used in the printing apparatus 100 shown in FIG. 1 in place of the fuser 112. Embodiments of the fuser 200 can also be used, e.g., in solid ink jet printing apparatuses.

In embodiments, the fuser 200 includes a fuser member in the form of a fuser roll 202. The fuser roll 202 includes an outer, fusing surface 206 forming the outer surface of an outer portion of the fuser roll 202. In embodiments, the outer portion is an outer layer 208. The outer layer 208 is formed on a dielectric material layer 213 overlying a core 210.

In the fuser 200, one or more optional heating elements 212 (two are shown) are positioned inside of the core 210. The heating elements 212 can be lamps, such as tungsten-quartz lamps. In embodiments, the heating elements 212 extend axially along the length of the fuser roll 202. The heating elements 212 are connected to a power supply 250 adapted to power the heating elements 212 to heat the core 210 and outer layer 208 of fuser roll 202. In embodiments, the power supply 250 and heating elements 212 are connected to a controller 220 adapted to control the power supply 250. The heating elements 212 can be powered, e.g., to maintain the fuser roll 202 at a desired temperature when the printing apparatus is in the low-power mode or standby mode between print jobs (i.e., the operating mode).

In the fuser 200, a pressure roll 204 having an outer surface 214 is positioned adjacent fuser roll 202. The outer surface 206 of fuser roll 202 and the outer surface 214 of pressure roll 204 define a nip 205 between them. As shown, a medium 222 carrying one or more toner images is fed to the nip 205. At the nip 205, the fuser roll 202 and the pressure roll 204 contact the medium 222 and apply heat and pressure to fuse the toner images onto the medium 222.

In embodiments, the outer layer 208 of the fuser roll 202 is comprised of a material that has electrical and thermal properties that are effective to allow the material to be rapidly heated to a desired, elevated temperature by applying a voltage to the material with a voltage source 230. In embodiments, the voltage source 230 is connected to the controller 220 adapted to control the voltage source 2300N and OFF. After toner is fused on a medium, the voltage supply can be stopped. In embodiments, the material of the outer layer 208 can cool quickly from the elevated temperature when the voltage is stopped. This characteristic of the material of the outer layer 208 allows the fuser 200 to be used to print media having different fusing temperatures in succession, e.g., a thick medium (e.g., a thick sheet of paper) followed by a thin medium (e.g., a thin sheet of paper).

In embodiments, the outer layer 208 can be heated quickly (e.g., in less than about 20 seconds, less than about 10 seconds, or less than about 5 seconds) to at least the temperature set point for the types of media that are fed to the fuser 200. The applied voltage is effective to heat the outer layer 208 to the desired temperature within the desired time period. In embodiments, the fuser 200 includes a media sensor 240, such as an optical sensor, located upstream of the nip 205 to sense the arrival of the medium 222 at the nip 205. In embodiments, the sensor 240 is connected to the controller 220. By sensing the arrival time of the medium 222 at the nip 205 using the sensor 240, voltage can be applied to the outer layer 208 by the voltage source 230 to heat the outer layer 208 to the desired temperature by the time that the medium 222 arrives at the nip 205. Typically, the fusing temperature can be, e.g., about 150° C. to about 210° C. for various types of media, including media having different weights and which are coated or uncoated. The outer layer 208 can be heated to at least the temperature set point while using less power than would be needed to heat the outer layer 208 using only the heating elements 212. The material of the outer layer 208 can then cool quickly from the elevated temperature to a lower temperature.

In embodiments of the fuser roll 202 that include heating elements 212, the outer layer 208 can cool to about the temperature of the outer layer 208 maintained by the heating element 212, such as to the idling temperature for the fuser roll 202, when the supply of voltage to the outer layer 208 by the voltage source 230 is stopped. In embodiments of the fuser roll 202 that do not include internal heating elements 212, the outer layer 208 can cool to about ambient temperature when the supply of voltage to the outer layer 208 is stopped.

Figure 3:
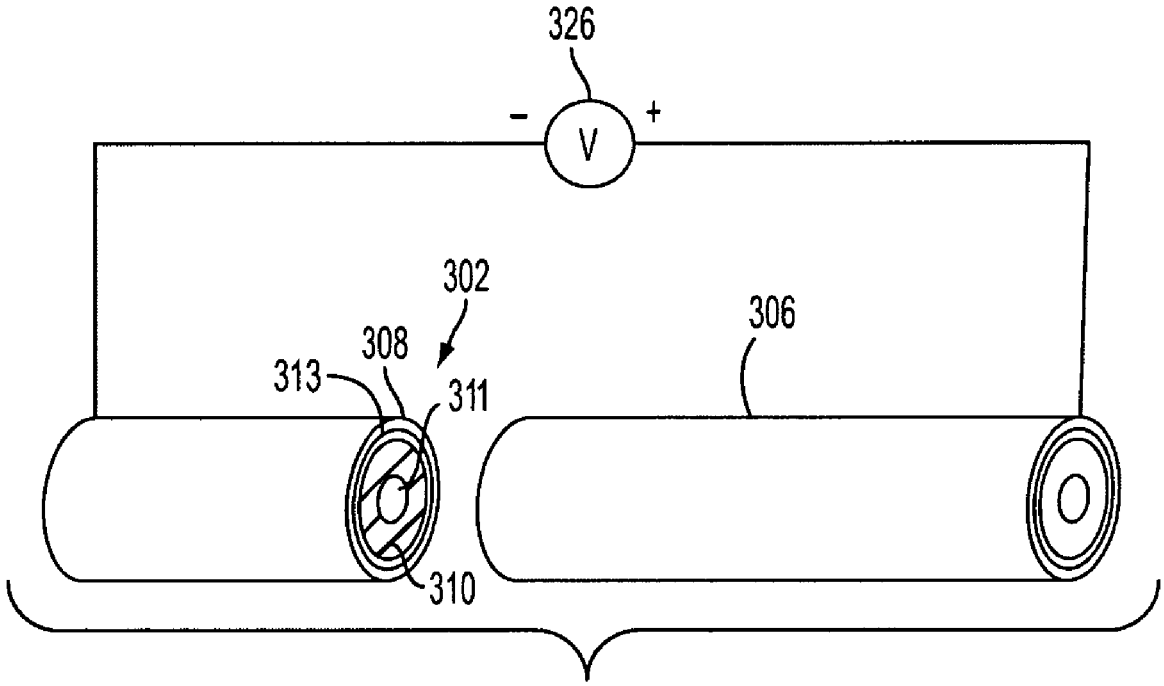
FIG. 3 illustrates an exemplary embodiment of a fuser roll.

FIG. 3 illustrates an exemplary embodiment of a fuser roll 302. As shown, the fuser roll 302 includes an outer portion, which is an outer layer 308 disposed on a dielectric material layer 313 overlying a core 310. The outer layer 308 has an outer surface 306. The core 310 includes a hollow interior 311 in which one or more optional heating elements (not shown) can be provided. The fuser roll 302 also includes axial shafts 322, 324 at opposed ends for engaging a drive mechanism adapted to rotate the fuser roll 302. The fuser roll 302 can be used in the fuser 200.

In embodiments, the core 310 is comprised of a metal, such as aluminum, or the like. In embodiments, the dielectric material layer 313 is comprised of a ceramic material, such as alumina, quartz, aluminum nitride, or the like; or a heat-resistant polymer, such as polyimide, or the like. In embodiments, the outer layer 308 can be formed as a coating on the dielectric material layer 313. In other embodiments, the outer layer 308 can be a pre-formed, cylindrical-shaped sleeve. The sleeve can be bonded to the dielectric material layer 313 using a suitable bonding material that can withstand operating temperatures reached by the outer layer 308.

In the illustrated embodiment, a voltage source 326 including positive and negative terminals is connected to the outer layer 308 at opposite ends of the fuser roll 302. In embodiments, the voltage source 326 is connected to the outer layer 308 by electrically-conductive rings and brushes placed at each end of the outer layer 308 to allow electrical current to be supplied from the voltage source 326 to the outer layer 308 as the fuser roll 302 is being rotated during operation of the fuser. In other embodiments, other suitable electrical connections of the voltage source 326 to the outer layer 308 can be used.

The outer layer 308 is comprised of a material having electrical resistivity and thermal conductivity properties that are effective to allow the material to be heated to a desired temperature in a short amount of time by applying a voltage (typically direct current (DC) voltage) to the outer layer 308 with the voltage source 326. In embodiments, the outer layer 308 is comprised of graphite, or a graphite-containing material, such as a composite material containing graphite and, e.g., carbon. A suitable material for forming the outer layer 308 (and outer layer 208 of fuser roll 202) is Athalite™, which is used in products commercially available from COLDHEAT™ of Bellevue, Wash. See U.S. Pat. Nos. 6,646,228 and 6,797,924, each of which is incorporated herein by reference in its entirety. The '228 and '924 patents disclose soldering irons including electrodes made of graphite or graphite-containing materials. The '228 and '924 patents disclose that other materials, which are semi-conductive and have low thermal conductivity, e.g., silicon and germanium, can be used to make the electrodes. The '228 and '924 patents disclose that the materials forming the electrodes have the following properties: electrical resistivity: at least 1,500 μΩ·cm, or over 3,000 μΩ·cm; thermal conductivity: <10 BTU/hr-ft-° F., or 1 BTU/hr-ft-° F. to 10 BTU/hr-ft-° F.; and the ability to reach a temperature of approximately 600° F. within a few seconds upon the application of electricity.

In embodiments, the material of the outer layer 208 of fuser roll 202 and the outer layer 308 of fuser roll 302 can have an electrical resistivity of at least about 500 μΩ·cm to at least about 3,500 μΩ·cm, such as at least about 1,000 μΩ·cm, at least about 1,500 μΩ·cm, at least about 2,000 μΩ·cm, at least about 3,000 μΩ·cm, or at least about 3,500 μΩ·cm; and a thermal conductivity of about 1 BTU/hr-ft-° F. to about 10 BTU/hr-ft-° F., such as about 1 BTU/hr-ft-° F. to about 5 BTU/hr-ft-° F., or about 5 BTU/hr-ft-° F. to about 10 BTU/hr-ft-° F. In embodiments, the outer layer 208 and outer layer 308 can be heated by an applied voltage to a temperature effective to heat media that contact these outer layers at the nip to a fusing temperature. For example, the temperature can be about 150° C. to about 210° C. for various types of media. In embodiments, such different types of media can be heated by the outer layer 208 and outer layer 308 to these temperatures in less than about 20 seconds, less than about 10 seconds, or less than about 5 seconds, by applying a suitable voltage to these layers. In such embodiments, the material of the outer layer 208 or outer layer 308 can be graphite, a graphite-containing material, or another material, such as a metal or semiconductor, that has electrical and thermal properties that are effective to allow the material to be rapidly heated to a desired, elevated temperature by applying a voltage to the material with a voltage source.

Embodiments of the fuser 200 can be used in print jobs for fusing toner on coated or uncoated media that have thicknesses ranging from thin to thick. For example, in embodiments of the fuser roll 202 that do not include optional heating elements 212, to print a thick sheet of paper using the fuser 200, voltage can be supplied to the outer layer 208 of fuser roll 202 to heat the outer surface 206 to a sufficiently-high temperature to fuse toner on the thick sheet. In such embodiments, the outer layer 208 can be heated more quickly by the applied voltage, and using less energy, than by heating the outer layer 208 using the heating elements 212. In other embodiments of the fuser roll 202 that also include heating elements 212, the outer layer 208 can be heated by applying voltage to the outer layer 208 to provide a supplemental heat source, and contribute a sufficient additional amount of heat (i.e., in addition to the heat supplied to the outer surface 206 by powering the heating elements 212) to fuse toner on media. The fuser 200 can provide efficient performance when used to print different types of media in the same printing apparatus.

Figure 4:
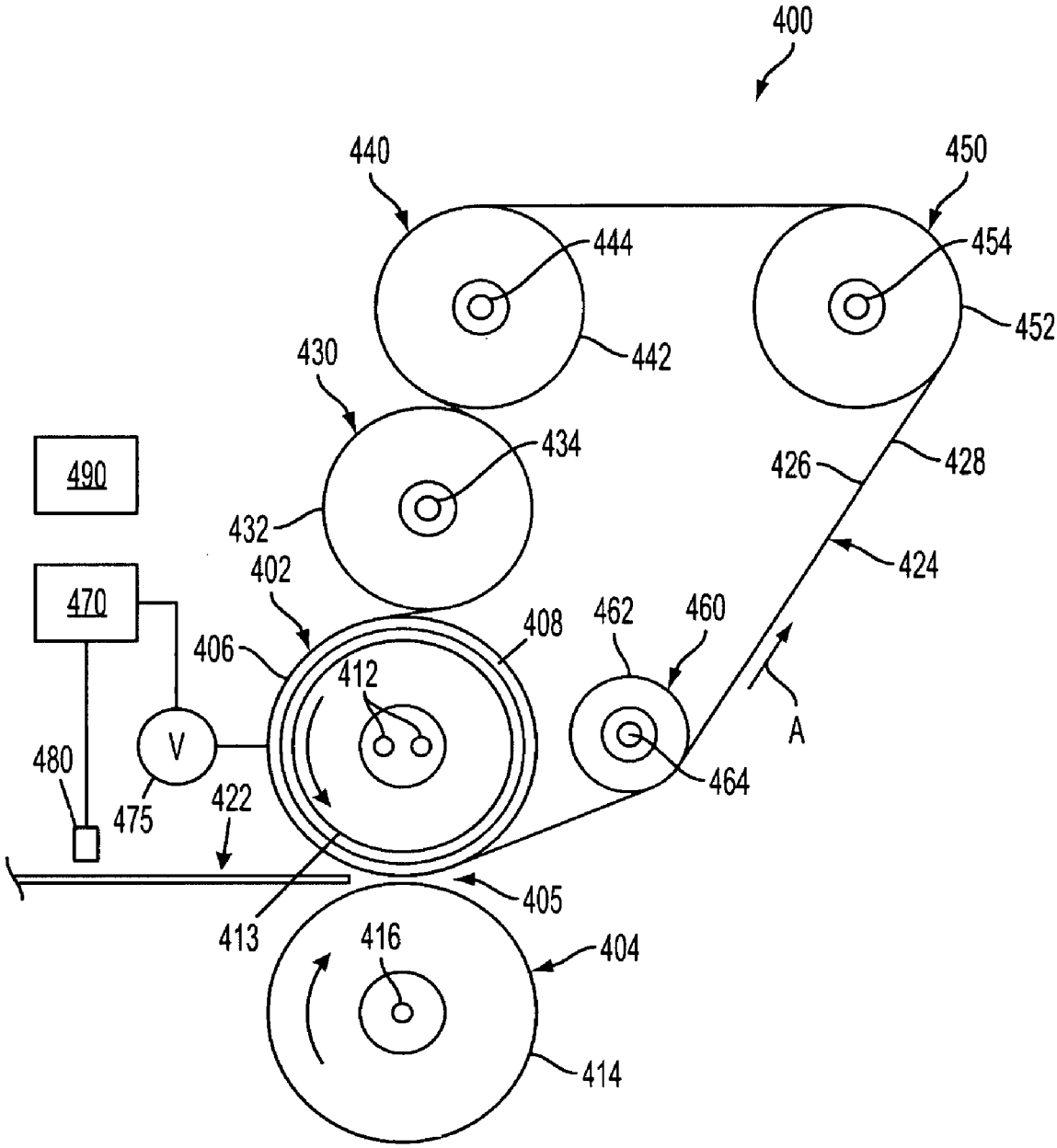
FIG. 4 illustrates an exemplary embodiment of a fuser including a fuser belt.

In other embodiments, the resistive materials having low thermal conductivity are used in fusers that include a fuser belt as the fuser member for heating media to temperatures effective to fuse toner onto media. FIG. 4 shows a fuser 400 according to such an embodiment. Embodiments of the fuser 400 can be used in different types of printing apparatuses. For example, the fuser 400 can be used in the printing apparatus 100 shown in FIG. 1 in place of the fuser 112. Embodiments of the fuser 400 can also be used, e.g., in solid ink jet printing apparatuses.

The fuser 400 includes a fuser roll 402, a pressure roll 404, and a nip 405 between the fuser roll 402 and pressure roll 404, which rotate in opposite directions, as shown. The fuser 400 also includes idler rolls 430, 440, 450 and 460. An endless (continuous) fuser belt 424 is supported on the fuser roll 402 and idler rolls 430, 440, 450 and 460. The fuser belt 424 has an inner surface 426 and an opposite outer surface 428. The fuser belt 424 is driven by a drive mechanism to rotate in the counter-clockwise direction shown by arrow A.

In the fuser 400, the fuser roll 402 and idler rolls 430, 440, 450 and 460 are internally heated. The fuser roll 402 and idler rolls 430, 440, 450 and 460 each include a hollow core. In embodiments, optional heating elements 408 are located inside fuser roll 402, and at least one optional heating element 434, 444, 454 and 464 is located inside idler rolls 430, 440, 450 and 460, respectively. The heating elements 408, 434, 444, 454 and 464 can be, e.g., tungsten quartz lamps, or the like, extending axially along the fuser roll 402 and idler rolls 430, 440, 450 and 460, respectively. In embodiments, the heating elements 408, 434, 444, 454 and 464 are connected to a power supply 490. The fuser 400 includes a controller 470 connected to the power supply 490. The heating elements 408, 434, 444, 454 and 464 heat outer surface 406 of fuser roll 402, outer surface 432 of idler roll 430, outer surface 442 of idler roll 440, outer surface 452 of idler roll 450, and outer surface 462 of idler roll 460, respectively. Heat is transferred from these rolls to the fuser belt 424.

In embodiments, the fuser roll 402 includes an outer layer 408 having an outer surface 406. The outer layer 408 is provided on a dielectric material layer 413. The dielectric material layer 413 is provided on a core typically comprised of metal. In embodiments, the outer layer 408 can be made of the same material used to form the outer layer 208 of the fuser roll 202 (FIG. 2), or the outer layer 308 of the fuser roll 302 (FIG. 3). The material of the outer layer 408 has electrical and thermal properties that are effective to allow the material to be rapidly heated to a desired temperature by applying a voltage to the material. The outer layer of fuser roll 402 is connected to a voltage source 475 adapted to apply a voltage to the outer layer effective to heat the outer surface 406 to a desired temperature. The voltage source 475 is connected to controller 470 to control heating of the outer layer of the fuser roll 402. The heated outer surface 406 of fuser roll 402 heats the fuser belt 424 moving over the outer surface 406.

An exemplary embodiment of the fuser belt 424 comprises a base layer of polyimide, or a like polymer; an intermediate layer of an elastomeric material, such as silicone, or the like, on the base layer; and an outer layer comprised of a fluoroelastomer sold under the trademark Viton® by DuPont Performance Elastomers, L.L.C., or a like polymer, on the intermediate layer. The base layer forms the inner surface 426 of fuser belt 424, and the outer layer forms the outer surface 428.

During operation of the fuser 400, a medium 422 carrying at least one toner image is fed to the nip 405 by a media feeding apparatus. At the nip 405, the outer surface 428 of the rotating fuser belt 424 contacts one face of the medium 422, and the surface 414 of the pressure roll 404 contacts the opposite face of the medium 422. The fuser belt 424 and pressure roll 404 apply sufficient heat and pressure to fuse the toner onto the medium 422.

In embodiments, the fuser 400 includes a media sensor 480, such as an optical sensor, located upstream of the nip 405 to sense the arrival of the medium 422 at the nip 405. The sensor 480 is connected to the controller 470. By sensing the arrival time of the medium 422 at the nip 405 using the sensor 480, voltage can be applied to the outer layer 408 of fuser roll 402 by the voltage source 475 to heat the outer surface 406 to the desired temperature by the time that the medium 422 arrives at the nip 405.

In embodiments, the heating elements 408, 434, 444, 454 and 464 can be powered to maintain the fuser belt 424 at a desired temperature, and the outer layer 408 of the fuser roll 402 can be heated additionally by applying a voltage to the outer layer 408 to heat the outer surface 406 to a temperature effective to fuse toner on media.

Figure 5:
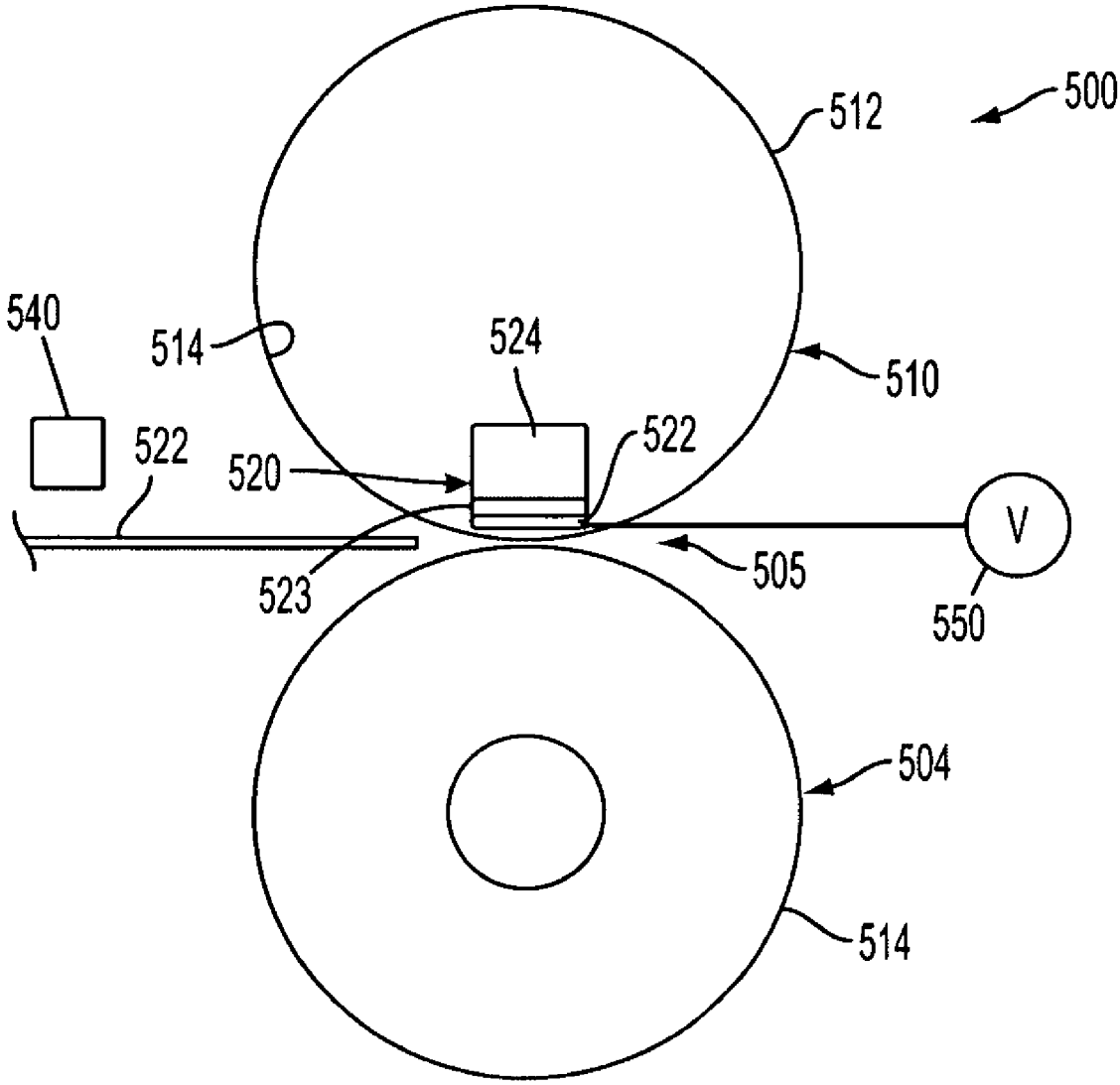
FIG. 5 illustrates an exemplary embodiment of a fuser including an internally-heated fuser belt.

FIG. 5 illustrates a fuser 500 according to another embodiment. The fuser 500 includes a rotatable, continuous fuser belt 510, a pressure roll 504 and a nip 505 between the fuser belt 510 and pressure roll 504. In embodiments, the fuser belt 510 is cylindrical shaped. The fuser belt 510 is typically comprised of a metal, such as steel, stainless steel, or the like. The fuser belt 510 has an outer surface 512 and an opposite inner surface 514. The outer surface 512 can be coated with a material having low friction properties and heat resistance, such as polytetrafluoroethylene (PFTE), or a like polymer. The fuser belt 510 is driven by the drive mechanism (not shown) to rotate in the counter-clockwise direction.

The fuser 500 further includes a heating member 520 with an outer layer 522, which is provided on a dielectric material layer 523, and a thermistor 524 located inside of the fuser belt 510. In embodiments, the heating member 520 is stationary. The outer layer 522 is urged downwardly into contact with the inner surface 514 of fuser belt 510 at the nip 505 by an applied load. In embodiments, substantially the entire bottom surface of the outer layer 522, which faces the inner surface 514, can be urged into contact with the inner surface 514. In embodiments, the bottom surface can be planar. The outer layer 522 extends axially along the fuser belt 510 to allow the entire length of the fuser belt 510 to be heated by the heating member 520.

In embodiments, the outer layer 522 can be made of the same material used to form the outer layer 208 of the fuser roll 202 (FIG. 2), the outer layer 308 of fuser roll 302 (FIG. 3), or the outer layer 408 of fuser roll 402 (FIG. 4). For example, the material of outer layer 522 can be graphite or a graphite-containing material. The outer layer 522 is connected to a voltage source 550, which is adapted to apply a voltage to the outer layer 522 effective to heat the outer layer 522 to a sufficiently-high temperature to heat the fusing surface 512 of fuser belt 510 to a temperature effective to fuse toner on media at nip 505. The material of the outer layer 522 has electrical and thermal properties that are effective to allow the material to be heated to a desired temperature in a short amount of time (e.g., less than about 20 seconds, less than about 10 seconds, or less than about 5 seconds) when voltage is applied to the material by voltage source 550.

In embodiments, the outer layer 522 can be a coating formed on the dielectric material layer 523. In other embodiments, the outer layer 522 can include one or more pieces of the resistive material bonded to dielectric material layer 523.

In the fuser 500, a suitable thermally-conductive lubricant can be applied to the inner surface 514 of the fuser belt 510 to reduce friction between the outer layer 522 and the inner surface 514 during rotation of the fuser belt 510.

The outer layer 522 is adapted to supply thermal energy to the inner surface 514 at the nip 505. During operation of the fuser 500, a medium 522 carrying at least one toner image is fed to the nip 505. At the nip 505, the heated outer surface 512 of the rotating fuser belt 510 contacts one face of the medium 522, while the outer surface 514 of pressure roll 504 contacts the opposite face of the medium 522. The fuser belt 510 and pressure roll 504 apply sufficient thermal energy and pressure to the medium 522 to fuse the toner onto the medium 522. In embodiments, the fuser 500 includes a media sensor 540, such as an optical sensor, located upstream of the nip 505 to sense the arrival of the medium 522 at the nip 505. In embodiments, the sensor 540 is connected to a controller (not shown). By sensing the arrival time of the medium 522 at the nip 505 using the sensor 540, voltage can be applied to the outer layer 522 by the voltage source 550 to result in the outer layer 522 being heated to the desired temperature by the time that the medium 522 arrives at the nip 505.

Embodiments of the fuser 500 are adapted to provide energy-efficient fusing of toner on media. The outer layer 522 of heating member 520 can be heated to a sufficiently-high temperature to heat the outer surface 512 of the fuser belt 510 at nip 505 to a temperature effective to fuse toner on various types of media at the nip 505 using low power.

Figure 6:
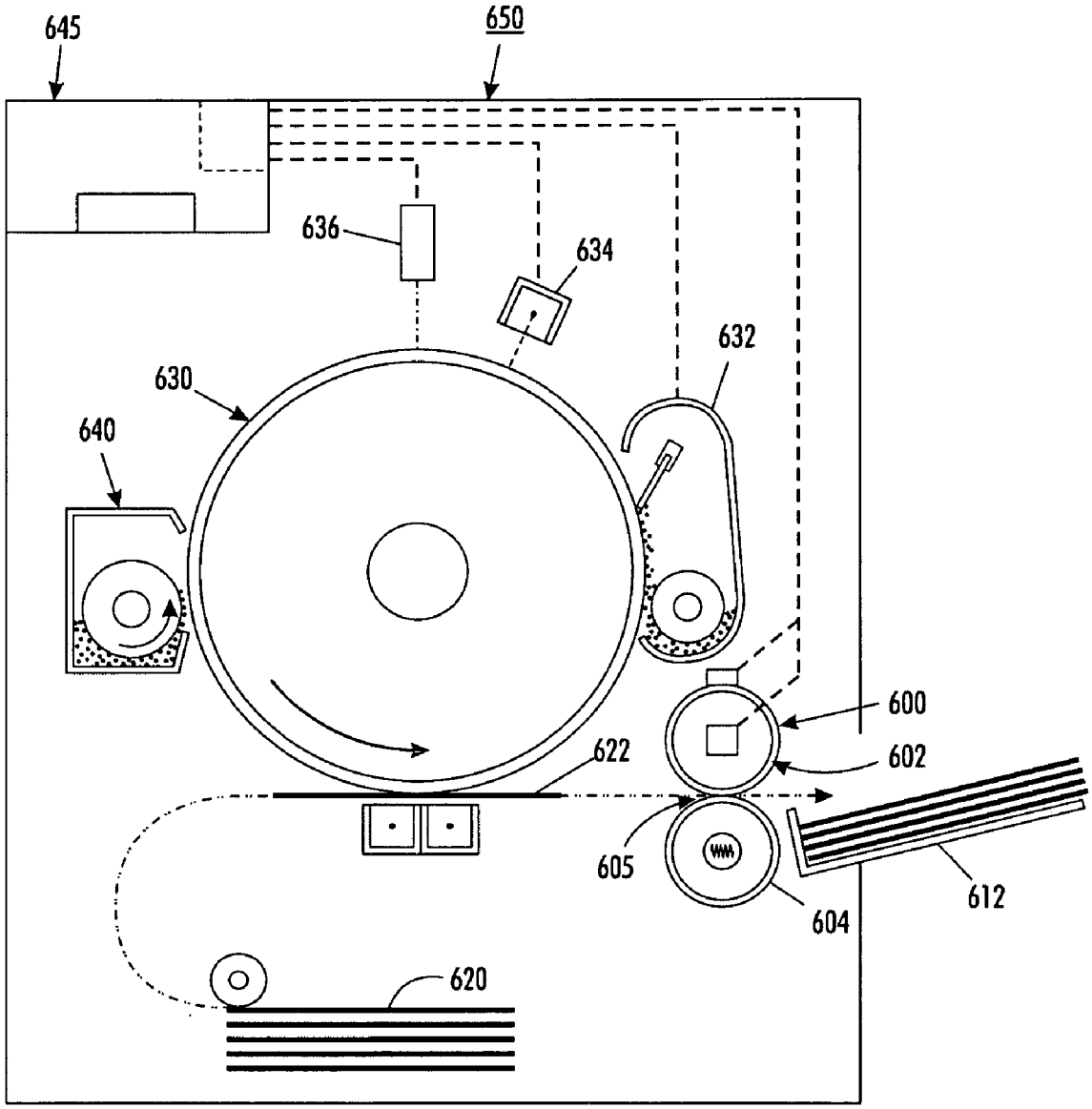
FIG. 6 illustrates an exemplary embodiment of a printing apparatus including a fuser with an internally-heated fuser belt.

FIG. 6 illustrates an embodiment of a printing apparatus 650, such as the printing apparatuses disclosed in U.S. Pat. No. 7,228,082, which is incorporated herein by reference in its entirety. The printing apparatus 650 includes a fuser 600 with a rotatable, continuous belt 602 and a pressure roll 604 defining a nip 605. Embodiments of the fuser 500 shown in FIG. 5 can be used in the printing apparatus 650 in place of the fuser 600. The printing apparatus 650 further includes a rotatable photoreceptor 630. To form toner images on the photoreceptor 630, a charging device 634 charges the outer surface of the photoreceptor 630. Then, an exposure device 636 forms an electrostatic latent image on the photoreceptor 630. Then, a developer device 640 applies toner particles to the electrostatic latent image to form a toner image on the photoreceptor 630. The toner image is transferred from the photoreceptor 630 to a medium 622 conveyed from sheet supply stack 620. The medium 622 carrying the toner image is conveyed to the nip 605 of fuser 600. The printing apparatus 650 includes a controller 645 adapted to control operation of the image-forming devices during printing. The controller 645 can control operation of the sensor 540 and voltage source 550 of the fuser 500. After the medium 622 has passed through the nip 605, the medium is conveyed to output tray 612.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser for heating media, comprising:

a fuser roll including an outer portion having a first outer surface, the outer portion being comprised of graphite or a graphite-containing material, wherein the material has an electrical resistivity of about 500 μΩ·cm to at least about 3,500 μΩ·cm, and a thermal conductivity of about 1 BTU/hr-ft-° F. to about 10 BTU/hr-ft-° F.;

a voltage source connected to the outer portion and adapted to supply voltage to the outer portion to heat the first outer surface;

a pressure roll having a second outer surface; and a nip between the first and second outer surfaces;

wherein the first and second outer surfaces are adapted to contact a medium at the nip.

2. The fuser of claim 1, wherein:

the fuser roll further comprises:

a metallic core;

a dielectric material overlying the core; and at least one heating element disposed inside the core and adapted to heat the outer portion; and the outer portion is an outer layer overlying the dielectric material.

3. A printing apparatus, comprising:

a fuser according to claim 1;

a sheet feeding device for feeding the medium, which has toner thereon, to the nip at which the first and second outer surfaces apply sufficient heat and pressure to the medium to fuse the toner onto the medium;

a sensor for sensing the arrival of the medium at the nip; and a controller connected to the voltage source and the sensor.

4. The fuser of claim 1, wherein:

the fuser roll further comprises:

a metallic core; and at least one heating element disposed inside the core and adapted to heat the core and outer portion; and the outer portion of the fuser roll is an outer layer overlying the surface of the core.

5. A printing apparatus, comprising:

a fuser according to claim 1;

a sheet feeding device for feeding the medium, which has toner thereon, to the nip at which the first and second outer surfaces apply sufficient heat and pressure to the medium to fuse the toner onto the medium;

a sensor for sensing the arrival of the medium at the nip; and a controller connected to the voltage source and the sensor.

6. A fuser for heating media, comprising:

a continuous fuser belt having an outer fusing surface and an opposite inner surface;

a graphite or graphite-containing material including a heating surface disposed inside of the fuser belt in contact with the inner surface, wherein the material has an electrical resistivity of about 500 μΩ·cm to at least about 3,500 μΩ·cm, and a thermal conductivity of about 1 BTU/hr-ft-° F. to about 10 BTU/hr-ft-° F.;

a voltage source connected to the material and adapted to supply voltage to the material to heat the heating surface, which heats the fuser belt;

a pressure roll having an outer surface; and a nip between the heating surface and the outer surface;

wherein the fusing surface and the outer surface are adapted to contact a medium at the nip.

7. The fuser of claim 6, wherein:

the fuser belt is comprised of metal;

the material forms a portion of a stationary heating member adapted to heat the fuser belt at the nip; and the material is disposed on a dielectric material.

8. A printing apparatus, comprising:

a fuser according to claim 6;

a sheet feeding device for feeding the medium, which has toner thereon, to the nip at which the fusing surface and the outer surface of the pressure roll apply sufficient heat and pressure to the medium to fuse the toner onto the medium;

a sensor for sensing the arrival of the medium at the nip; and a controller connected to the voltage source and the sensor.

9. The fuser of claim 6, wherein:

the heating surface is an outer surface of a rotatable fuser roll comprising:

a metallic core including a surface; and at least one heating element disposed inside the core and which is adapted to heat the core and the fusing surface; and the outer portion of the fuser roll is an outer layer overlying the surface of the core.

10. The fuser of claim 6, wherein:

the fuser belt is comprised of metal; and the heating surface is an outer surface of a stationary heating member adapted to heat the fuser belt at the nip.

11. A printing apparatus, comprising:

a fuser according to claim 6;

a sheet feeding device for feeding the medium, which has toner thereon, to the nip at which the first and second outer surfaces apply heat and pressure to the medium to fuse the toner onto the medium;

a sensor for sensing the arrival of the medium at the nip; and a controller connected to the voltage source and the sensor.

12. A method of fusing toner on a medium, comprising:

feeding a medium having toner thereon to a nip between an outer fusing surface of a fuser member and an outer surface of a pressure roll;

applying a voltage to a graphite or graphite-containing material that forms the fusing surface or supports the fusing surface so as to heat the fusing surface, wherein the heating surface is comprised of a material having an electrical resistivity of about 500 μΩ·cm to about 3,500 μΩ·cm, and a thermal conductivity of about 1 BTU/hr-ft-° F. to about 10 BTU/hr-ft-° F.; and contacting the medium with the fusing surface and the outer surface to fuse the toner onto the medium.

13. The method of claim 12, wherein the heating surface is an outer surface of a continuous fuser belt having an opposite inner surface, and the material is an outer layer of a fuser roll contacting the inner surface.

14. The method of claim 12, wherein:

the heating surface is an outer surface of a continuous metallic fuser belt having an opposite inner surface;

the material is an outer layer of a stationary heating member adapted to contact the inner surface at the nip; and the outer layer is disposed on a dielectric material.

15. The method of claim 12, wherein the heating surface is an outer surface of a fuser roll.

* * * * *